US005797695A

United States Patent [19]

Prusmack

[11] Patent Number: 5,797,695

[45] Date of Patent: Aug. 25, 1998

[54] ARTICULATING HUB ASSSEMBLY

[76] Inventor: A. Jon Prusmack, 74 Omni Parc Dr., Nanuet, N.Y. 10954

[21] Appl. No.: 522,749

[22] Filed: Sep. 1, 1995

[51] Int. Cl.[6] ..... F16B 7/04

[52] U.S. Cl. ..... 403/170; 403/218; 52/648.1; 135/145

[58] Field of Search ..... 403/169, 170, 403/171, 172, 173, 174, 175, 176, 178, 217, 218; 52/648.1, 646; 135/143, 145, 147

[56] References Cited

U.S. PATENT DOCUMENTS

| | | | |
|---|---|---|---|
| 4,026,313 | 5/1977 | Zeigler | 52/109 X |
| 4,280,521 | 7/1981 | Zeigler | 135/120.3 |
| 4,355,918 | 10/1982 | Van Vliet | 403/218 X |
| 4,512,097 | 4/1985 | Zeigler | 52/109 X |
| 4,982,546 | 1/1991 | Lange | 403/174 X |
| 5,069,572 | 12/1991 | Niksic | 403/218 X |
| 5,074,094 | 12/1991 | Gassler | 403/171 X |
| 5,328,286 | 7/1994 | Lee | 403/218 |

FOREIGN PATENT DOCUMENTS

| | | | |
|---|---|---|---|
| 1784527 | 8/1971 | Germany | 403/170 |
| 1392220 | 4/1988 | U.S.S.R. | 403/171 |
| 8902958 | 4/1989 | WIPO | 403/176 |

*Primary Examiner*—Kenneth J. Dorner
*Assistant Examiner*—Harry C. Kim
*Attorney, Agent, or Firm*—Thomas A. Beck

[57] ABSTRACT

An articulation hub assembly which connects tubular rod elements comprises the frame matrix for portable collapsible self-supporting prefabricated structures requiring clear span interiors with no supporting columns. In the event a rod element secured by the hub assembly is fractured, the hub assembly is disassembled easily to allow replacement of the rod element.

14 Claims, 5 Drawing Sheets

ARTICULATING HUB ASSSEMBLY

FIELD OF THE INVENTION

The present invention relates to an articulating hub assembly used as a connector among tubular rod elements comprising the frame matrix for collapsible self-supporting prefabricated structures requiring clear span interiors with no supporting columns.

BACKGROUND OF THE INVENTION

Hub assemblies have been used in the construction of exhibit display stands and dome-like structures such as geodesic domes.

U.S. Pat. No. 3,968, 808 discloses a collapsible self-supporting dome-like structure with a network of pivotal rods interconnected with linking joints. The linking joint holds six rods, each connected to a six-sided metal ring. Each rod is connected onto the ring and is capable of rotating. The rod is a permanent attachment and thus cannot be disconnected nor replaced. There does not appear any way to attach a cover to the dome-like structure such as is found in the "keeper" component in the articulating hub assembly of the present invention.

U.S. Pat. No. 4,026,313 also discloses a collapsible self-supporting dome-like structure with a network of pivotal rods interconnected with linking joints. The pivotal device linking the rods together forming the structure is a circular joint. Each joint has only four rods. Each rod contains a plug ending with a small cylinder. This small cylinder is nested inside the joint and allows the rod to rotate. It appears that none of the components is easily interchanged. The top and bottom sections of the hubs in the reference appear to be permanently joined by an adhesive so that none of the rods or plugs can be replaced.

U.S. Pat. No. 4,512,097 discloses a display panel mounting clip. The clip body is used to connect display panels together. The clip assembly disclosed requires a spring mechanism to create tension and hold the panels together. The present invention requires no springs. The clip disclosed in the reference must be snapped into an opening joining the rods in a circular joint. In the present invention, the circular hub is screwed into the hub section so it is threadedly secured.

U.S. Pat. No. 4,280,521 discloses a hub assembly for collapsible structures. The hub assembly disclosed in the reference requires a circular retaining ring to hold the "column like elements" or tubes in place. Each tube must be threaded onto a circular retaining ring prior to insertion into the hub section. In the present invention no circular ring is present or required to hold the rods together inside the hub to allow rotation. The present invention as explained in detail hereinafter requires that each tube have its own tang, each with its own roll pin to independently nest inside the hub body. Thus no ring is present.

The hub sections are secured in place by use of an adhesive to fuse the two hub sections together permanently. The tube members within the structure, therefore, are not easily replaceable since the hub sections cannot be replaced without destroying them.

The reference design uses a three piece clamping device to hold or attach a skin or cover to the structure. One piece is a plug that is incorporated inside the hub section and is fused into the hub sections. The second piece is a flat disc. The third piece is an element which is a screw. The screw is threaded into the plug and holds the clamp down. A screw driver would obviously be required to remove the clamp if the cover, the skin or the tubes have to be replaced.

The hub assembly of the present invention is a substantial improvement over the reference assembly. The present invention uses a single large one-piece screw down clamp referred to as a "keeper." The wide mushroom shaped top of the keeper holds the fabric or skin in place while the post screws in to the bottom section of the hub. In addition, the shape of the keeper's mushroom top contours with the top section of the of the hub to maintain a snug and even fit of any skin or cover present. No mechanical device, such as a screwdriver as noted above, is required.

This feature is very important for quick field repair or replacement of covers. Another advantageous feature is that the keeper is large and not easy to lose in the field when the cover is being replaced or repair work is required.

SUMMARY OF THE INVENTION

The unique articulating hub assembly of the present invention is an integration of eight separate components that when connected form a novel means for pivotally joining a network of tubes forming the matrix for a collapsible structure. Multiple assemblies are used as pivotal devices for the movement of tubes to allow the quick erection and striking of a tubular frame supported structure.

A first significant feature of the present invention is to allow the tubes to articulate or move when either upward, i.e., vertical, or opposing side, i.e., horizontal, forces are applied. These forces cause a 180° (i.e., a semi-circular) rotation of the tube components comprising up to eight tubes per hub.

More specifically, with respect to a collapsed network of tubes, assemblies, etc. laid out prior to erection, when manual upward pressure is applied at 90° (i.e., perpendicular) to the ground at specific locations on the network, multiple hub assemblies are displaced from positions physically contacting the ground to specific elevated positions above the ground. The upward vertical force creates an action that moves the articulating hub assemblies of the present invention from static positions to tension positions and forms a structure of interconnected tubes and articulating hub assemblies that is self supporting. The resultant structure has four physical sides. The size and the shape of the structure can vary based upon the length of the tubes and the location of the scissor points.

To collapse the frame to its original position on the ground, simultaneous and opposing forces are applied on each of the four sides of the structure, 180° to each other and 90° to the vertical (along the 0 or X-axis), to specific articulating hub assemblies.

This action allows the tubular frame to move from a tension position with the assemblies above ground, back to a static position and collapse down to the original location on the ground.

A second significant feature of the articulating hub assembly of the present invention is the ability to secure a fabric cover (covering the tubular frame network) to the hub body and allow the cover to move simultaneously with the tubular frame. The mushroom shaped threaded "keeper" component is inserted through an opening in the cover and screws into the hub body. This arrangement semi-permanently fixes and secures the fabric cover to the tubular frame. In this manner the frame and cover produce a quick erect fabric covered shelter.

The third significant feature of the present invention is that all components are interchangeable.

Objects and features as well as additional details of the present invention will become apparent from the following detailed description and annexed drawings of the presently preferred embodiments thereof, when considered in conjunction with the associated drawings.

DESCRIPTION OF THE PREFERRED EMBODIMENT

As noted above, the present invention relates to an articulating hub assembly which serves to connect tubular rods that comprise the basic construction elements for a prefabricated self-supporting structure .

Figure 1:
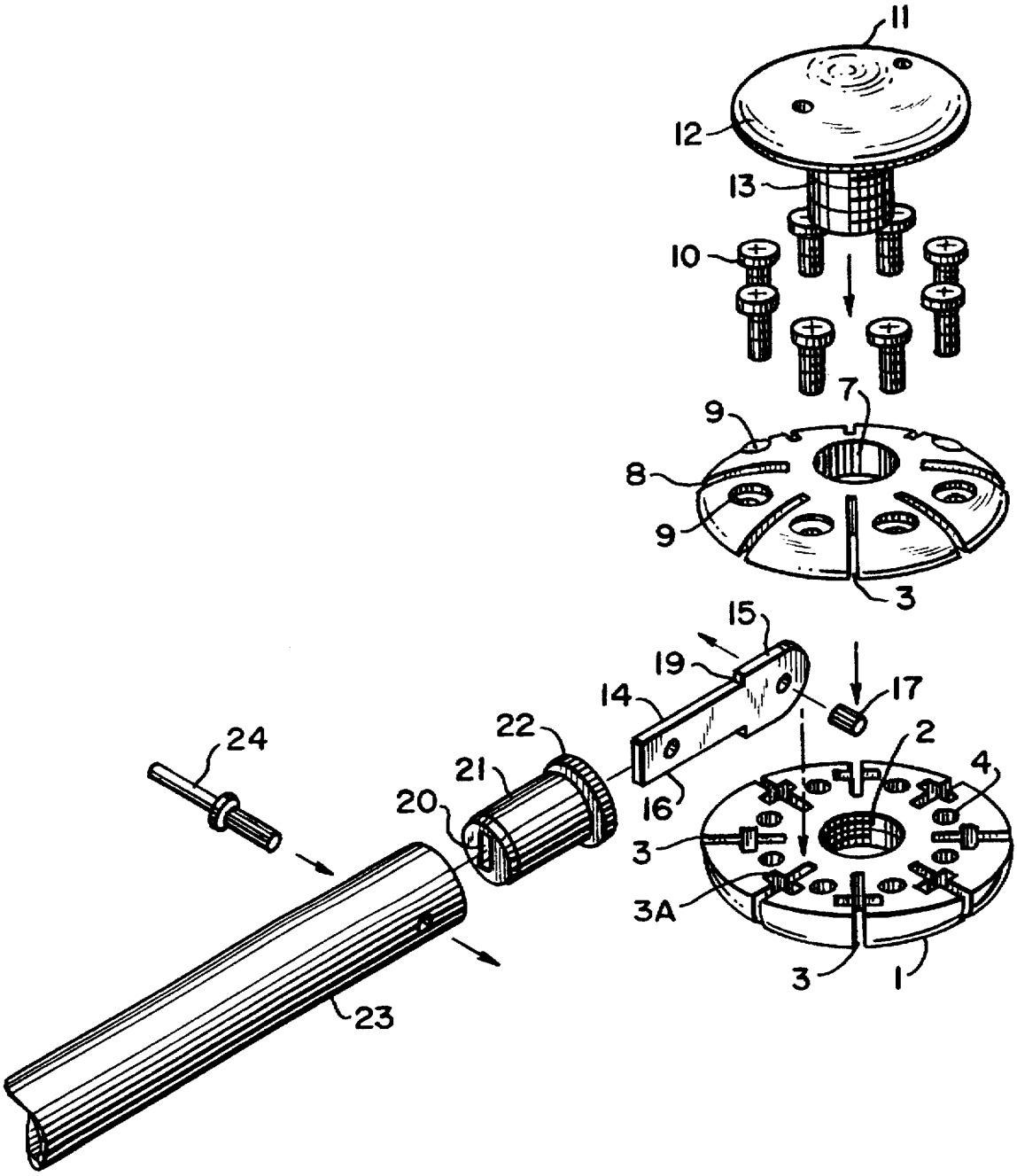
FIG. 1 is an exploded perspective view of the articulating hub assembly components of the present invention.

The components of the articulating hub assembly are depicted in FIG. 1. Hub body 1 is a disc like unit having a central opening 2 therethrough and a series of radial slots 3 extending inwardly from the periphery of disc 1 and having a series of openings 4 extending through disc 1 and positioned radially between each of the radial slots 3 and between periphery 5 and central opening 2. A groove 3A is located perpendicular to each of radial slots 3.

Hub cover 6 is similarly formed with central opening 7 and radial slots 8 and openings 9. The hub body 1 and hub cover 6 are assembled contiguously so that central openings 2 and 7, radial slots 3 and 8 and openings 4 and 9 are in registry. Hub cover 6 is secured to hub body 1 via screws 10. Hub cover 6 does not require grooves wherein the roll pins will rest. Keeper 11 is a mushroom shaped element wherein top 12 is contoured to match the contoured slope of the exposed surface of hub cover 6 and the shaft 13 of keeper 11 is threaded to coincide with the thread present in central openings 4 and 9 and possesses the same diameter as those openings to allow it to be threadedly engaged therein.

Figure 2:
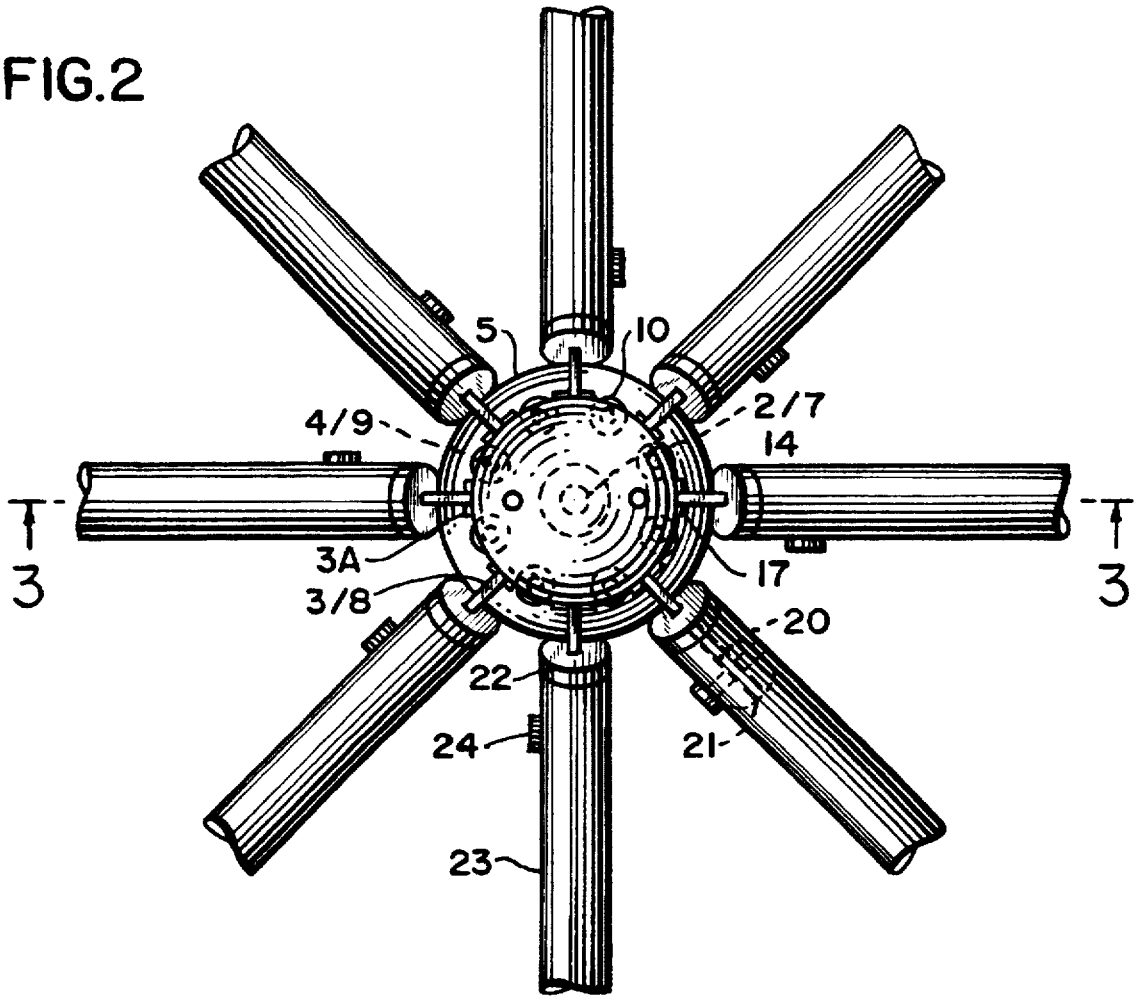
FIG. 2 is a plan view of the articulating hub assembly components of the present invention showing the tubes that comprise the structural frame.

FIG. 2 is a plan view of the articulating hub assembly with the tubes and relevant parts shown in FIG. 1 in their respective locations when the assembly is in use. This top view does not include the fabric which covers the tubular structure.

Figure 3:
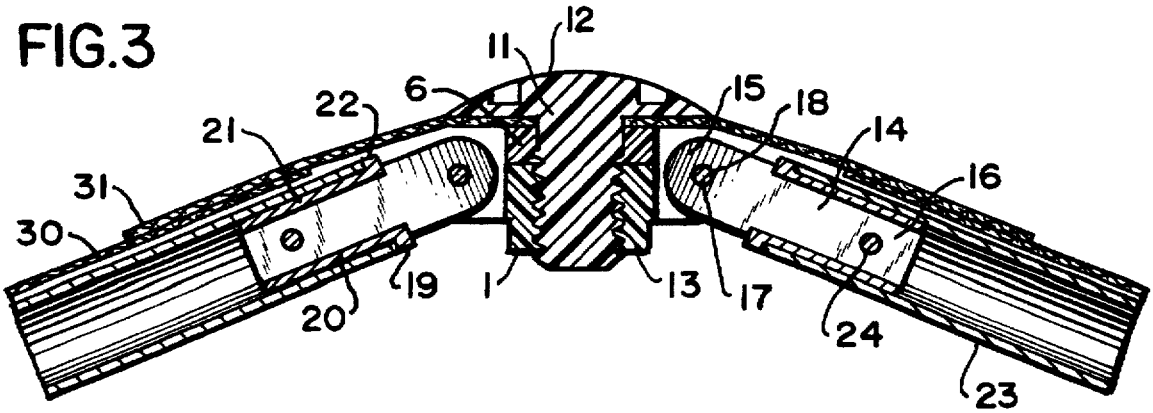
FIG. 3 is a cross sectional view of the articulating hub assembly taken along the line 3—3 in FIG. 2.

FIG. 3 is a cross sectional view of the assembly depicted in FIG. 2 showing the elements detailed in FIG. 1. This side view does show the fabric cover 30 and a reinforcing circle of fabric 31 which is fixed to the cover in the area where the hub assembly is installed over the skeletal matrix. The cover can be any suitable fabric such as canvas, nylon, polyester, etc. and can be impregnated with fire retardants, insect repellents, etc.

Into each of the radial slots 3 and 8 formed by securing hub body 1 to hub cover 6, a tang 14 having a head 15 and a tail 16 is inserted. Tang 14 is held in place by a roll pin 17 which is inserted through an opening 18 through head 15 and is secured in groove 3A.

Head 15 of tang 14 is wider than tail 16 and merges therewith at shoulder 19. Tang 14 is long enough to extend radially outward from radial slots 3 and 8. Tail 16 of tang 14 possesses a width substantially the same as a slot 20 that extends radially through plug 21. Plug 21 is generally and preferably cylindrical in shape and has a crown 22 at one end which rests against shoulder 19 when assembled. The plug has a continuous peripheral surface and is not segmented. The diameter of the portion of plug 21 beyond crown 22 is substantially the same as the inside diameter of rod or tubular element 23. When assembled, rivet 24 secures tang tail 16, in plug 21 to tube 23.

Figure 4:
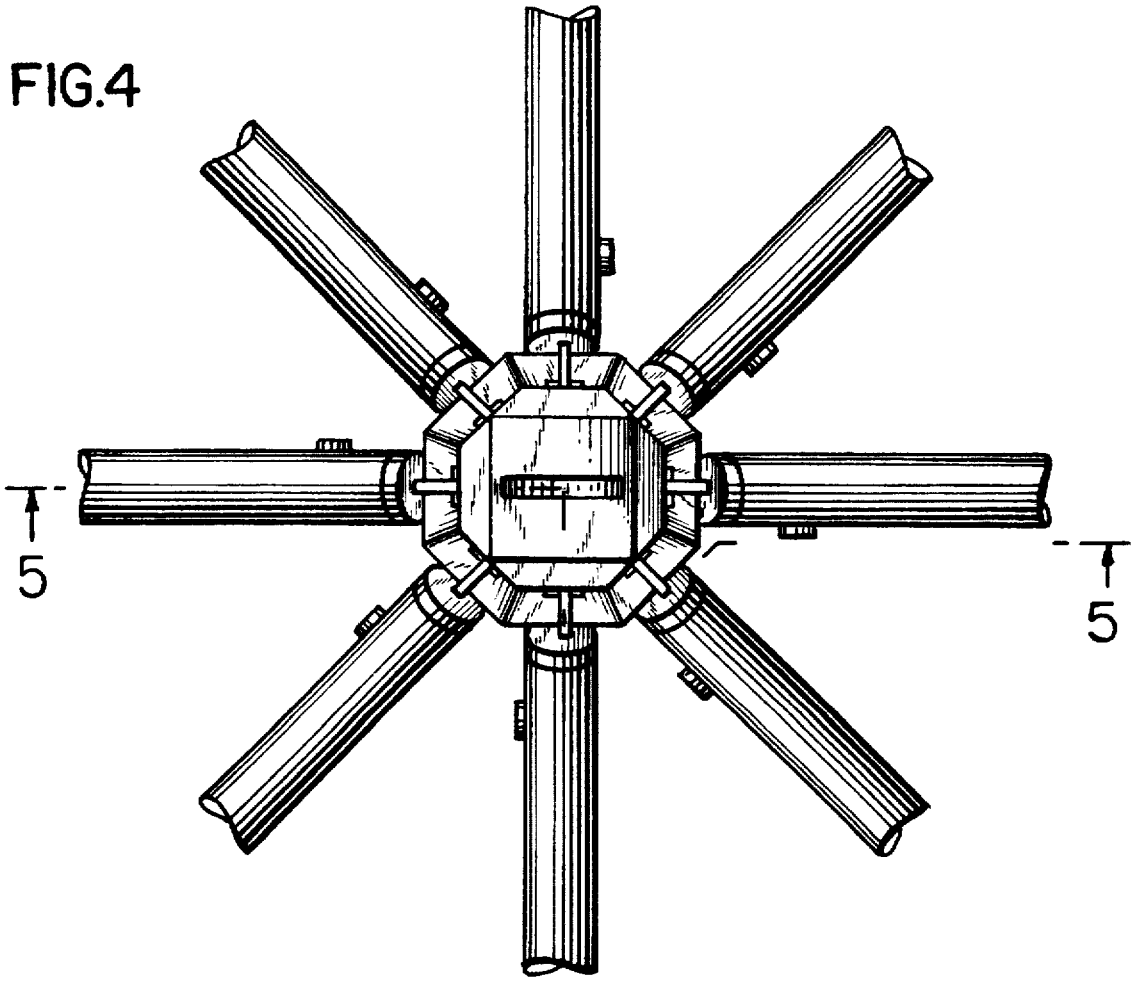
FIG. 4 is a plan view of an alternative embodiment articulating hub assembly.

The hub cover and hub body may be circular or angular, i.e. octagonal, in shape. FIG. 4 depicts a plan view of an octagonal shaped embodiment of the hub assembly showing the top of hub cover 6A and rectangular keeper 11A.

Figure 5:
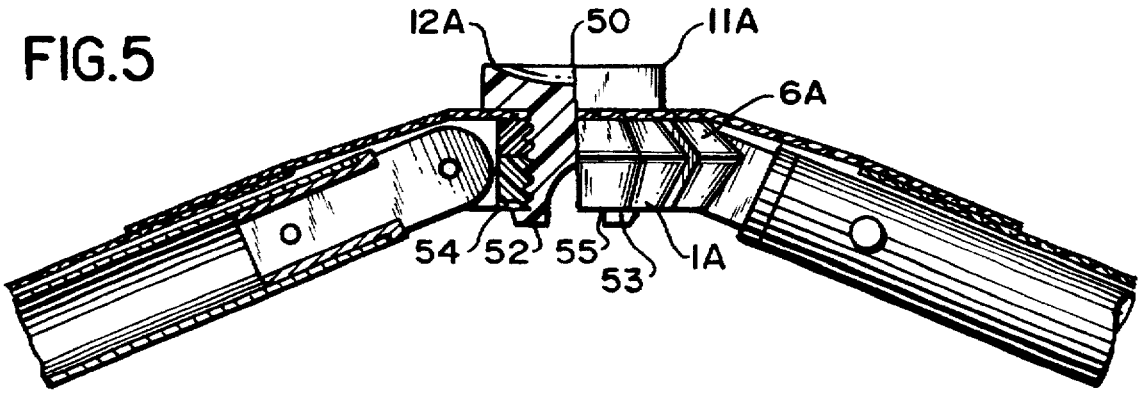
FIG. 5 is a cross sectional view of an alternative embodiment articulating hub assembly taken along the line 5—5 in FIG. 4.

FIG. 5 depicts a side view taken along the line 5—5 of FIG. 4 of the octagonal embodiment showing hub body 1A, hub cover 6A and keeper 11A.

It will be noted in FIG. 5 that an alternative embodiment of keeper 11 of FIG. 2 is depicted. The keeper 11A possesses a top 12A which is a rectangular shaped head having a depression head 50 therein. The purpose in having a depression is to enable the construction crew to insert and remove the keeper easily. Any shape keeper will be effectively used.

More particularly, keeper 11A comprises top 12A having a depression area 50 therein and shaft 51 which extends into the flexible end sections 52 and 53 which serve as connectors and which are flexible and capable of splaying and locking into openings 54 and 55 located on the underside of hub body 1A.

In the embodiment depicted in FIG. 5 the keeper secures hub cover and hub body together as a result of the shaft section extending through the central opening in the hub cover and the hub body, with the tip ends of the flexible connectors fixed into openings 54 and 55.

The keeper can also be inserted from the bottom side of the hub body and fixed into hub cover with the fastening connectors. Since the keeper in this instance is a snap mechanism, it can be inserted either from the bottom or the top of the hub assembly.

Figure 6:
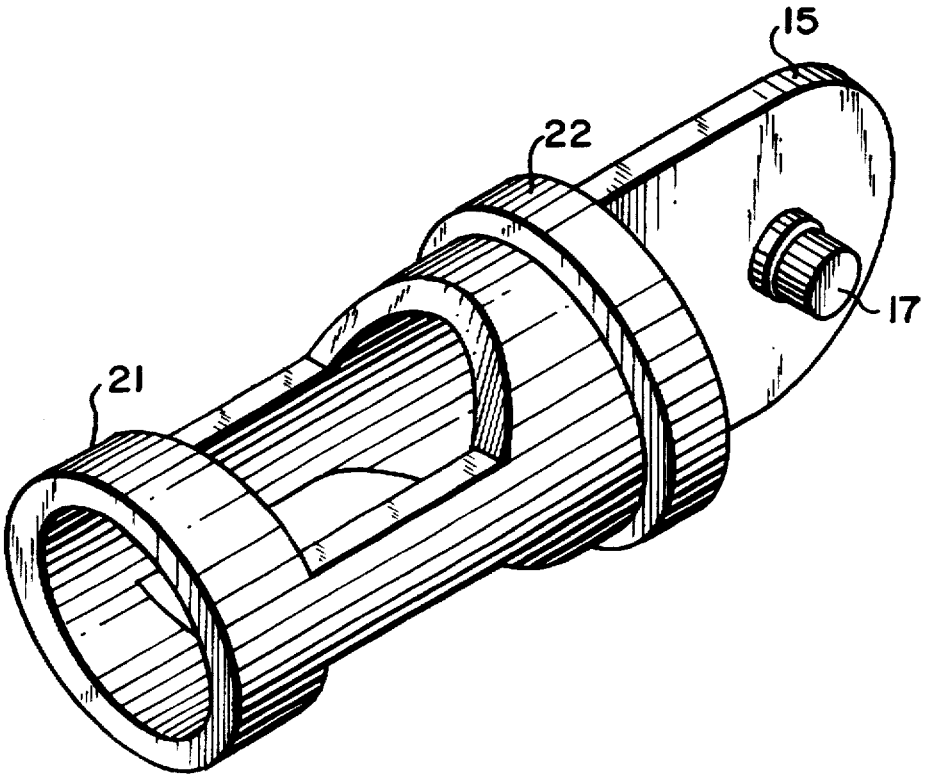
FIG. 6 is an isometric view of the tang/plug combination.

In another embodiment shown in FIG. 6, the tang includes a head section with a roll pin extending out from each side of the head section. Rather than having a tail section that extends through the plug, the head section is joined directly perpendicular to the surface of the plug facing the hub cover and the hub body when in use or installed. In this embodiment, the head of each tang is adapted to fit in one of the radial slots in the hub body and hub cover when in registry, with the tang being held in place by the roll pin nested in the groove in the hub body.

Figure 7:
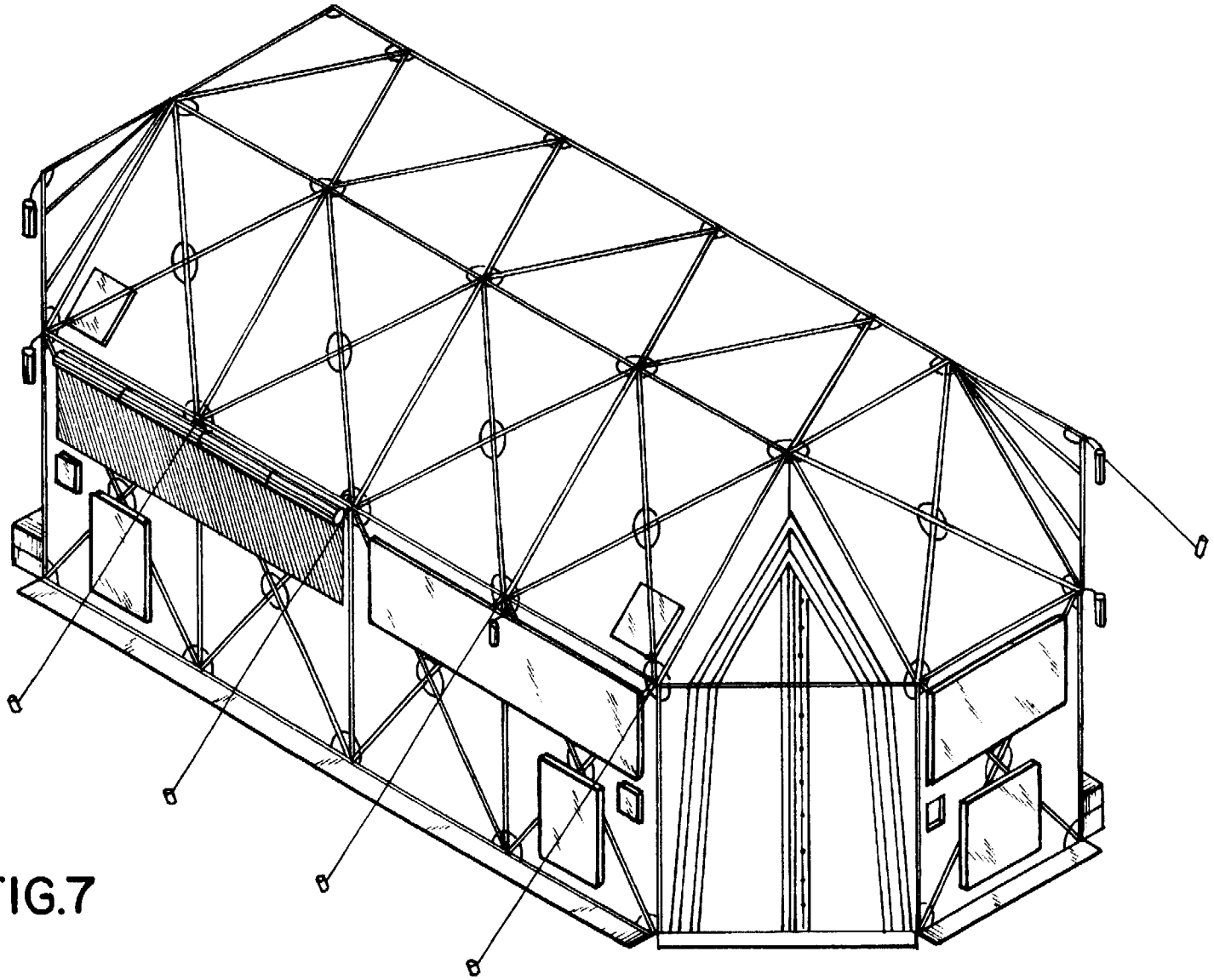
FIG. 7 is an isometric view of shelter comprising the articulating hub assembly and tubes.

FIG. 7 depicts an isometric view of a shelter showing a plurality of articulating hub assemblies connected to tubes together forming the matrix upon which the fabric cover rests and to which it is secured. A benefit of the shelter directly resulting from the articulating hub assembly is the portability of same and ability to raise large structures from small transporting packages. For example, an assembled shelter covering 386 $ft^2$ can be carried to the site for striking in a parcel 5 ft × 3 ft × 2 ft.

All the components described above are interchangeable. The hub sections are joined together using screws making replacement a simple step. Also the tubes can be individually replaced without having to remove the entire collection of tubes before the individual tube in the collection is replaced such as is the case in the prior art.

Thus while there have been shown, described and pointed out fundamental features of the invention as applied to currently preferred embodiments thereof, it will be understood that various omissions and substitutions and changes in form and details of the method and apparatus illustrated, and in their operation, may be made by those skilled in the art without departing from the spirit of the invention. In addition it is to be understood that the drawings are not necessarily drawn to scale but that the are merely conceptual in nature. It is the intention, therefore, to be limited only by the scope of the claims appended herewith.

What I claim and desire to protect by Letters Patent is:

1. An articulating hub assembly suitable for use in collapsible structures, said assembly comprising:

a hub body having a periphery, a central opening therethrough and a plurality of radial slots extending inwardly from said periphery of said hub body, each of said radial slots in said hub body having a discontinuous groove located perpendicular thereto, said hub body also having a series of openings extending through said hub body, said openings being positioned radially between each of said radial slots and between said periphery and said central opening of said hub body;

a hub cover having a periphery, a central opening therethrough, a plurality of radial slots and a series of openings extending through said hub cover, said hub body and said hub cover being assembled contiguously so that said central opening, said radial slots and said openings of said hub cover are in registry with said central opening, said radial slots and said openings of said hub body;

removable fastening means, said removable fastening means extending through said openings in said hub cover and being secured in said openings in said hub body;

an integrally formed keeper element having a top and a shaft extending downwardly therefrom, wherein said shaft is capable of being inserted and withdrawn from said central openings of said hub body and said hub cover, said shaft having means for securing said hub cover to said hub body;

a plurality of tangs, each of said tangs having a first and second sides, said each tang comprising a head section with a roll pin extending from each of said sides, said head section of said tang being positioned in one of said radial slots of said hub body and said hub cover in registry therewith, said tang being held in place by said roll pin nested in said discontinuous groove; and a cylindrical plug having a crown and a structural element secured to said tang.

2. The articulating hub assembly defined in claim 1 wherein said hub body central opening is threaded.

3. The articulating hub assembly defined in claim 2 wherein said keeper shaft is threaded to coincide with the central threaded opening of said hub body to allow said shaft to be threadedly engaged therein.

4. The articulating hub assembly defined in claim 3 wherein said tang further comprises a tail section with an opening therethrough, said head section having an opening therethrough, said head section of said tang fitting in said radial slots of said hub body and said hub cover in registry therewith, said tang being held in place by said roll pin which is inserted through said opening of said head section and which is nested in said discontinuous groove.

5. The articulating hub assembly defined in claim 4 wherein said structural element is a tubular structure having a predetermined inside diameter, and said cylindrical plug having a first end with said crown thereon with a slot extending longitudinally therethrough, said first end of said plug being adapted to receive said tail section of said tang, a portion of said plug being substantially identical to the inside diameter of said tubular structure.

6. The articulating hub assembly defined in claim 5 wherein a rivet secures said tail section of said tang positioned in said plug to said tubular structure.

7. The articulating hub assembly defined in claim 5 wherein a cover is atop said tubular structure which is secured in place between said keeper element and said hub cover and said hub body.

8. The articulating hub assembly defined in claim 4 wherein said head section of said tang is wider than said tail section and merges therewith at a shoulder.

9. The articulating hub assembly defined in claim 1 wherein said hub body and said hub cover are circular in shape.

10. The articulating hub assembly defined in claim 1 wherein said top of the keeper element is contoured to match a contoured slope of an exposed surface of said hub cover.

11. The articulating hub assembly defined in claim 1 wherein said keeper shaft is unthreaded and fits through said central openings of said hub body and said hub cover, said keeper shaft having an end opposite said top of said keeper element wherein said end being divided into two elements which are splayed to be fixed to an underside of said hub body to join said hub body to said hub cover.

12. The articulating hub assembly defined in claim 11 wherein said head section of said tang is joined directly perpendicular to the surface of said plug facing said hub cover and said hub body when installed.

13. The articulating hub assembly defined in claim 11 wherein said hub body and said hub cover are octagonal in shape.

14. The articulating hub assembly defined in claim 1 wherein said assembly is made of metal, thermoplastic or thermoset material.

* * * * *